US006786335B1

(12) United States Patent
Gropper et al.

(10) Patent No.: US 6,786,335 B1
(45) Date of Patent: Sep. 7, 2004

(54) PYROLYSIS PLANT FOR REFUSE AND METHOD FOR SCREENING SOLID RESIDUES

(75) Inventors: Georg Gropper, Weissenhorn (DE); Reinhold Riggenmann, Weissenhorn (DE); Winfried Von Rhein, Freigericht (DE); Helmut Werdinig, Nürnberg (DE)

(73) Assignee: Infineon Technologies AG, Munich (DE)

( * ) Notice: Subject to any disclaimer, the term of this patent is extended or adjusted under 35 U.S.C. 154(b) by 720 days.

(21) Appl. No.: 09/718,894

(22) Filed: Nov. 22, 2000

Related U.S. Application Data

(63) Continuation of application No. PCT/DE99/01482, filed on May 17, 1999.

(30) Foreign Application Priority Data

May 22, 1998 (DE) ..... 198 23 018

(51) Int. Cl.[7] ..... B07B 15/00

(52) U.S. Cl. ..... 209/12.1; 209/44; 209/44.3; 209/270; 209/654; 209/669; 201/25; 201/21; 110/235

(58) Field of Search ..... 209/12.1, 44, 44.3, 209/270, 654, 669; 201/25, 21; 110/235

(56) References Cited

U.S. PATENT DOCUMENTS 4,261,795 A * 4/1981 Reilly ..... 202/118
6,484,882 B1 * 11/2002 Boretzky et al. ..... 209/19
6,622,869 B1 * 9/2003 Riggenmann et al. ..... 209/307

* cited by examiner

*Primary Examiner*—Walter D. Griffin
*Assistant Examiner*—James Arnold, Jr.
(74) *Attorney, Agent, or Firm*—Laurence A. Greenberg; Werner H. Stemer; Gregory L. Mayback

(57) ABSTRACT

A pyrolysis plant for refuse and a method for screening solid residues provide a sure and trouble-free sieving of a solid material using a sieving device having a configuration which is as simple as possible. A spiral formed by a rod which is wound in a helicoidal manner, or a plurality of such rods, are provided as the sieving device. The rod or rods can rotate around a longitudinal axis. The solid material is introduced into an interior formed by the rod for sieving, preferably with the assistance of an aligning device for longitudinally extended solid material parts. The spirals include, in particular, a bend so that the lodged solid materials can automatically detach themselves. The sieving device is especially suited for sieving pyrolysis residual material.

31 Claims, 3 Drawing Sheets

PYROLYSIS PLANT FOR REFUSE AND METHOD FOR SCREENING SOLID RESIDUES

CROSS-REFERENCE TO RELATED APPLICATION

This application is a continuation of copending International Application No. PCT/DE99/01482, filed May 17, 1999, which designated the United States.

BACKGROUND OF THE INVENTION

Field of the Invention

The invention relates to a pyrolysis plant for refuse and a method for screening solid residues, through the use of which coarse solid fragments are separated from finer solid fragments.

In many industrial areas of use, it is necessary for solids which are contained, for example, in bulk material to be separated into a plurality of fractions. The fractions are, as a rule, subdivided according to different solid sizes, solid geometries or solid constitutions. Separation of solids is desirable whenever the different solid fractions are to be supplied for further treatment.

In the building industry, for example, building debris which occurs is separated from large and bulky debris constituents which are then sorted and reutilized. The separated finer building debris is disposed of, for example, at a dump provided for that purpose.

In the field of waste disposal, separation and sorting of the waste or of residues occurring during waste utilization are of ever-increasing importance with a view toward disposal which is as protective of the environment as possible. An essential factor therein is the separation of waste according to its size. Separation may be carried out before the waste is utilized. However, it may also be an essential method step in waste utilization itself.

Thermal methods are known for the elimination of waste, in which the waste is burned in refuse incineration plants or pyrolysed in pyrolysis plants, that is to say subjected to a temperature of about 400° C. to 700° C., with air being excluded. In both methods, it is expedient to separate the residue remaining after incineration or after pyrolysis, in order to either supply it for reutilization or dispose of it in a suitable way. The aim, in that case, is to keep the amount of residue to be ultimately stored at a dump as low as possible.

European Patent Application 0 302 310 A1, corresponding to U.S. Pat. No. 4,878,440, and a company publication entitled "Die Schwel-Brenn-Anlage, eine Verfahrensbeschreibung" ["The Low-Temperature Carbonization Incineration Plant, a Method Description"], published by Siemens AG, Berlin and Munich, 1996, disclose, as a pyrolysis plant, a so-called low-temperature carbonization incineration plant, in which essentially a two-stage method is carried out. In the first stage, the waste supplied is introduced into a low-temperature carbonization drum (pyrolysis reactor) and is carbonized there at low temperature (pyrolysed). During pyrolysis, low-temperature carbonization gas and pyrolysis residue occur in the low-temperature carbonization drum. The low-temperature carbonization gas is burned, together with combustible parts of the pyrolysis residue, in a high-temperature combustion chamber at temperatures of approximately 1200° C. The waste gases occurring at the same time are subsequently purified.

The pyrolysis residue also has non-combustible constituents in addition to the combustible parts. The non-combustible constituents are composed essentially of an inert fraction, such as glass, stones or ceramic, and of a metal fraction. The useful materials of the residue are sorted out and supplied for reutilization. It is necessary to have methods and components which ensure reliable and continuous operation for the sorting-out process.

In the case of screening devices, there is often the problem of screen surfaces becoming clogged. The screening device then breaks down, or at least it must be subjected to complicated and labor-intensive cleaning. The problem of the blockage of the screening device arises particularly when the solid to be separated has a highly inhomogeneous composition. Thus, for example, wires catch in perforated plates used as screen surfaces, so that the individual holes are first narrowed and, in time, become clogged.

The residue occurring during the pyrolysis is typically a highly inhomogeneous solid which has pronounced differences in terms of its material composition, its size and the geometry of its solid fragments. The residue contains not only stones, broken glass and larger metal fragments, but also elongate bars and entangled wires (wire pellets).

A device for discharging pyrolysis residue from a low-temperature carbonization drum is known, for example, from International Publication No. WO 97/26495, in order to provide for the separation of coarse pyrolysis residue. The discharge device includes a conveying device which has a separating bottom with a sawtooth-like profile as well as a downstream bar screen. The separating bottom is set in vibration, so that the fine constituents are separated from the coarse on the separating bottom. The fine constituents fall through the downstream bar screen, while the coarse constituents slide along on the latter. However, wire pellets may catch on the bars and lead to a blockage.

SUMMARY OF THE INVENTION

It is accordingly an object of the invention to provide a pyrolysis plant for refuse and a method for screening solid residues, which overcome the hereinafore-mentioned disadvantages of the heretofore-known devices and methods of this general type and in which continuous operation is ensured by simple measures, without blockages occurring.

With the foregoing and other objects in view there is provided, in accordance with the invention, a pyrolysis plant for refuse, comprising a screening device having an interior for receiving solid residues, a rod wound along a helical line and bounding the interior, and a longitudinal axis, the screening device rotatable about the longitudinal axis.

The decisive advantage of a screening device constructed in this way is to be seen in that wire pellets or other solids cannot remain adhering to the rod. Thus, due to the rotation of the screening device and because of the turn of the rod, the wire pellets are thereby pushed down in the conveying direction. Blockages are therefore effectively avoided.

In accordance with another feature of the invention, the rod is constructed as a spiral with a plurality of turns, in particular with about four to ten turns.

In a screening device of this kind, which may also be referred to as a "spiral screen", the solids to be screened are introduced into the interior formed by the three-dimensional spiral. Fine solids having smaller dimensions than the distance between two turns of the spiral fall through the spiral, while coarse solids are conveyed further in the interior. The maximum size of the screened finer solid constituent can be set by a suitable choice of the distances between the turns. The rotational movement of the spiral ensures that the coarser solid fragments are transported reliably and continuously in the conveying direction from the start to the end of the spiral.

An essential advantage of the spiral is that waste fragments possibly jammed between two turns are raised as a result of the rotational movement and, in particular, fall down due to their dead weight at an upper reversal point. The simple and robust construction of the screening device as a spiral therefore automatically avoids permanent blockages and allows continuous operation.

In accordance with a further feature of the invention, a number of rods are provided and the rod starts thereof are disposed so as to be offset in terms of rotation. In this case, each rod runs along a helical line. Such a screen having a plurality of rods is also referred to as a multi-flight screen.

In accordance with an added or alternative feature of the invention, the angle of rotation of the rods is smaller than 360°. In particular, the angle of rotation is smaller than or approximately equal to 180°. The screening device may be constructed with a plurality of rods which do not execute a complete revolution, so that it can be made more robust, as compared with a spiral screen having a plurality of turns.

In accordance with an additional feature of the invention, there is provided a rod element fixed relative to the rod, both in the spiral screen and in the multi-flight screen. The rod element runs essentially parallel to the outer surface formed by the spiral or parallel to the outer surface formed by the multi-flight screen.

This rod element acts as follows as a stripping element: when a wire pellet catches on the rod, then, as a result of the rotational movement of the screen, this wire pellet is guided against the fixed rod element and is stripped off from the rod by the fixed rod element along the helical line. In order to achieve this, the direction of rotation of the rod is suitably coordinated with the direction of rotation of the screening device.

In accordance with yet another feature of the invention, in order to provide stripping which is as efficient as possible, the rod element is likewise wound along a helical line, specifically and in particular in opposition to the rod, so that, for example, the rod element forms an angle of preferably 90° with the rod.

In accordance with yet a further feature of the invention, the spiral is fastened in the spiral screen only at one of its two ends, so that the spiral axis is curved downwards in the direction of gravity towards its non-fastened end as a result of dead weight. Preferably, the spiral is held only at the spiral start, while the spiral end which is located in the conveying direction is constructed to be freely suspended.

As an alternative to a spiral fastened on one side, an already curved spiral may also be fastened on both sides. It is essential that the spiral be curved.

The decisive advantage of the curvature is to be seen in that the distances between the turns on the underside of the spiral are smaller than the distances on the top side of the spiral. Solids introduced into the spiral may, in principle, be jammed only between turns on the underside of the spiral, since the solids fall downwards due to their dead weight, as soon as they are raised. In other words: due to the spiral movement, a jammed solid fragment is raised upwards along with the spiral. At the same time, the distance between the turns widens, so that the solid fragment cannot remain jammed between the turns and necessarily falls down due to its dead weight. The screening device with a curved spiral is therefore to a great extent self-cleaning.

In accordance with yet an added feature of the invention, in order to make the curvature of the spiral possible, it is expedient for the spiral to have a flexible construction. At the same time, stresses acting on the spiral due to jammed solid fragments are thereby kept low.

In accordance with yet an additional feature of the invention, in order to provide a stable and simple construction, the rod forming the spiral is advantageously metallic and, in particular, a round iron bar or an iron or steel tube. Such a spiral is extremely robust and is also suitable, in particular, for the coarse separation of heavy and large solids. The spiral is made from plastic, for example, for instances of use in which only slight loads occur.

In accordance with again another feature of the invention, there is provided an aligning device for the alignment of elongate solid fragments in the conveying direction in the screening device. The aligning device is disposed upstream of the rod in the conveying direction and opens into the interior.

The alignment of elongate solid fragments ensures that they are introduced, essentially parallel to the longitudinal axis, into the interior. Elongate solid fragments are therefore likewise treated automatically as coarse solid fragments and conveyed further. They cannot fall through the spiral perpendicularly to the longitudinal axis. This ensures that the solid fragments falling through the screen formed by the rod or rods are only those which have their largest dimensions being smaller than the distance between two turns of the spiral or the distance between two rods.

In accordance with again a further feature of the invention, the aligning device is constructed as a drum rotatable about its longitudinal axis in order to ensure simple alignment of the elongate solid fragments. The solid fragments are automatically aligned in the direction of the drum axis by virtue of the rotational movement of the drum.

In accordance with again an added feature of the invention, there is provided a coil, that is to say a helically wound strip, placed on the inside of the drum. This coil prevents solids, introduced into one drum end, for example through a filler shaft, from running through the drum at too high a speed, so that the solids "fly" through the interior formed by the rod, without screening taking place. Preferably, the coil has a multi-flight construction for this purpose, that is to say a plurality of helical strips, which are disposed so as to be offset in terms of rotation. The coil is, in particular, disposed directly on the inlet side of the drum and has a relatively high side.

In accordance with again an additional feature of the invention, the coil is constructed in such a way that it forms a closed circle, as seen in a top view in the direction of the longitudinal axis of the drum.

This rules out the possibility of solids on the drum bottom being able to slide through, unobstructed, in a straight line from the drum entrance as far as the drum exit. A multi-flight coil with an angle of rotation smaller than 360° is preferred so as not to impede the solid flow unnecessarily. In this case, the desired overlap of the side is achieved and, at the same time, a relatively low pitch of the coil is made possible, so that it becomes possible for solids to be transported quickly within the drum.

In an alternative embodiment, the aligning device is constructed as a profiled vibrating bottom which is provided with longitudinal grooves running in the conveying direction and in which the elongate solid fragments are aligned in these longitudinal grooves due to the vibrations of the vibrating bottom.

In accordance with still another feature of the invention, the rod is fastened to the drum on the end surface of the drum located in the conveying direction and, in particular, is welded there. The rod is preferably fastened in such a way that the drum exit opens into the interior formed by the rod.

Therefore, in order to provide a frictionless material discharge from the drum, the rod is fastened to the outer wall of the drum or is at least flush with the drum.

In this embodiment, the aligning device and the rod form a structural unit with a particularly simple construction which is robust and reliable.

In accordance with still a further feature of the invention, the screening device is connected to a discharge side of a low-temperature carbonization drum of a pyrolysis plant for the screening of pyrolysis residues obtained from the low-temperature carbonization drum.

In the pyrolysis plant, a first separation of the pyrolysis residue into a fine and a coarse residue fraction is preferably carried out through the use of the screening device. Reliable and continuous operation of the entire pyrolysis plant is ensured by virtue of the simple and particularly robust construction of the screening device.

It is particularly advantageous and expedient for the screening device to be fixedly connected directly to the low-temperature carbonization drum on the discharge side of the latter. Consequently, no other components, which may cause a fault, are interposed between the low-temperature carbonization drum and the screening device. The rod is, for example, fastened directly to a discharge pipe of the low-temperature carbonization drum and is disposed within a discharge device. This discharge device is preferably sealed off in a gas-tight manner relative to the outside atmosphere, in order to avoid the ingress of atmospheric oxygen which would lead to combustion of the combustible and hot pyrolysis residue.

In accordance with still an added feature of the invention, particularly for the purpose of the coarse screening of residue from a large-scale pyrolysis plant, the distance between two turns of the spiral or between two rods is advantageously about 100 mm to 300 mm and, in particular, about 180 mm.

In accordance with still an additional feature of the invention, the interior formed by the rod has a length of about 0.5 to 1.5 m. Its diameter amounts to about 1.5 m, and a screening device with a drum and a screen preferably has a total length of about 2 to 4 m. The length of the interior is expediently smaller than or equal to the diameter of the drum.

With the objects of the invention in view, there is also provided a method for screening solid residues from a pyrolysis plant for refuse, which comprises providing a screening device having a longitudinal axis, an interior and a rod wound along a helical line; introducing residues into the interior of the screening device rotating about the longitudinal axis; and conveying coarse residue constituents with the rod for separating the coarse residue constituents from pure residue constituents.

In accordance with a concomitant mode of the invention, there is provided a method which comprises initially aligning the residues in a conveying direction in an aligning device and subsequently screening the residues with the rod.

The advantages and particular embodiments explained with reference to the screening device also apply accordingly to the method.

Other features which are considered as characteristic for the invention are set forth in the appended claims.

Although the invention is illustrated and described herein as embodied in a pyrolysis plant for refuse and a method for screening solid residues, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
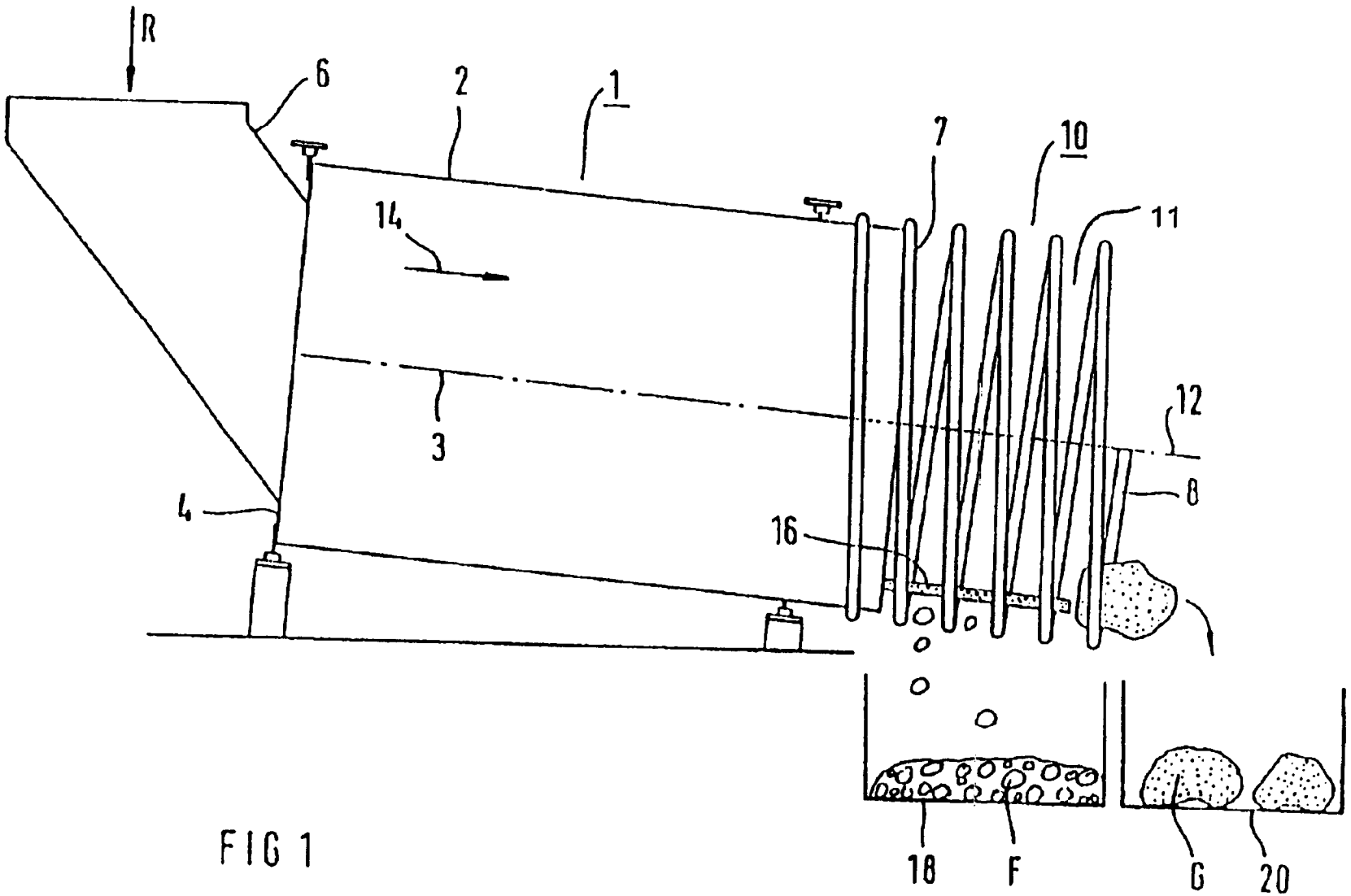
FIG. 1 is a diagrammatic, side-elevational view of a screening device, in which a drum as an aligning device is fixedly connected to a spiral.

Referring now to the figures of the drawings in detail and first, particularly, to FIG. 1 thereof, there is seen a screening device 1 which includes an aligning device, specifically a drum 2, that is rotatable about its longitudinal axis and which is inclined relative to the horizontal. A shaft-like feed device 6 for solids R is disposed on a left-hand end surface 4 of the drum 2. These solids R are, for example, pyrolysis residue or building debris. A metal rod 8 which is wound along a helical line and which forms a spiral 10 with an interior 11, is fastened to a right-hand end surface 7 of the drum 2. The right-hand end surface 7 is located opposite the feed device 6. The spiral 10 is fastened to the drum 2, for example through the use of a suitable welded, screwed or clamping connection. The spiral 10 is approximately flush with the drum 2, so that the diameter of the drum 2 and that of the spiral 10 are approximately equal. This makes it possible to use the entire right-hand end surface 7 as a drum exit for the solids R, and to construct the drum 2, for example, as a simple metal tube. A common longitudinal axis 3 of the screening device 1 and of the drum 2 coincides essentially with a spiral axis 12 of the spiral 10.

The drum 2 is mounted rotatably and can be set in rotation through a drive which is not illustrated in detail. The spiral 10 fastened to the drum 2 also rotates together with the drum 2. According to FIG. 1, the spiral has five turns. The distance between two adjacent turns depends on the type of solids R. In the present case, it is preferably about 180 mm. The spirally wound rod 8 is formed of a robust material and, in particular, is metallic. It is, for example, a round iron bar or a steel tube. The spiral 10 is fastened on only one side, specifically to the drum 2. Its spiral end facing away from the drum 2 is free of fastening devices and is not supported. The spiral 10 will therefore curve downwards towards its non-fastened end due to gravity. This is discussed in more detail further below with reference to FIG. 2.

The solids R are introduced into the drum 2 through the feed device 6 and are transported in a conveying direction 14 towards the spiral 10 as a result of the inclination of the drum 2 and of the rotational movement. Fine solids F are separated in the spiral 10, while coarse solids G are transported further by the spiral 10.

An essential advantage of the screening device 1 having the spiral 10 is to be seen in that even solids R flowing sluggishly are transported in the conveying direction 14 in a simple way as a result of the rotational movement.

Due to the rotational movement of the drum 2, elongate solid fragments 16 are at the same time aligned in the conveying direction 14, so that they are guided, approximately parallel to the spiral axis 12, into the interior 11 of the spiral 10. This reliably avoids a situation in which the elongate solid fragments 16 pass into the spiral 10 perpendicularly to the spiral axis 12 and fall through the spiral 10. Only the fine solids F can therefore fall through the spiral 10, and they are collected in a first collecting container 18 and transported away, as required. The coarse solids G are led through the spiral 10. At the end of the spiral 10, the coarse solids G fall into a second collecting container 20 and are likewise transported away, as required. Conveying devices, such as transport belts or transport worms, may also be provided instead of the collecting containers 18, 20, in order to transport the solids F, G away continuously.

Figure 2:
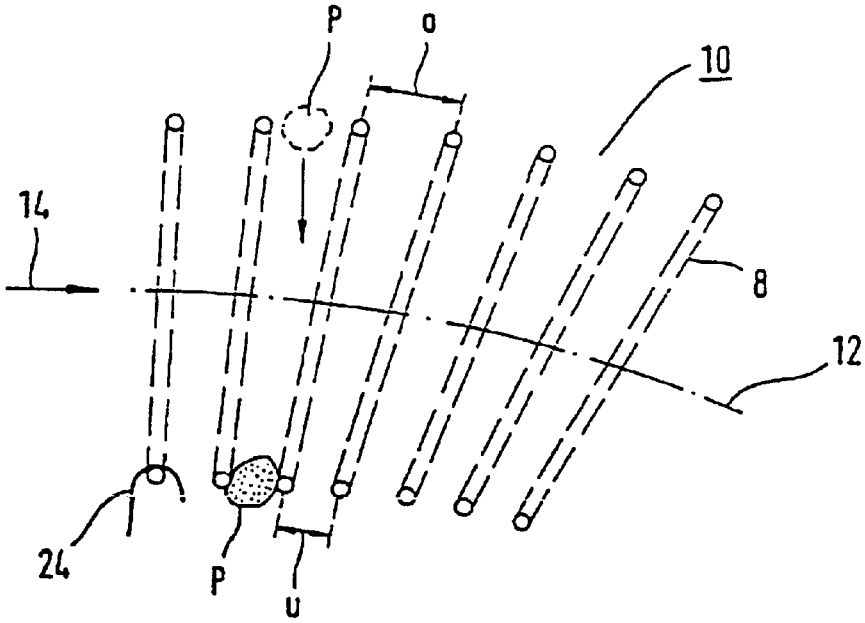
FIG. 2 is a sectional view through a curved spiral, which is provided in order to explain an advantageous action of the screening device.

FIG. 2 shows a diagrammatic, sectional view through a curved spiral 10. The essential functional principle of the curved spiral 10 is explained with reference to this figure. According to FIG. 2, the spiral axis 12 (and with it, the entire spiral 10) has a curvature. By virtue of the curvature, an upper distance o between two successive turns is greater than a lower distance u between two turns. A solid fragment R can only be jammed in the lower region of the spiral 10, where the distance u between two turns is small. A jammed solid fragment P is conveyed upwards as a result of the rotational movement of the spiral 10 and, at the same time, the distance between the turns becomes greater, so that the solid fragment P is released and falls down.

The same applies analogously to wire pieces 24 or similar solid fragments which are hook-shaped and catch over the rod 8 with a hook opening. If the screen were to move in only one plane, such wire pieces 24 would, as a rule, lead to blockage. In the present case, during rotation, a wire piece 24 is guided upwards together with the spiral 10. The hook opening is directed upwards, particularly at an upper reversal point of the spiral 10, so that the wire piece 24 can fall down.

This advantageous mechanism of the spiral 10 is obtained, irrespective of whether or not the spiral 10 has a curvature.

Figure 3:
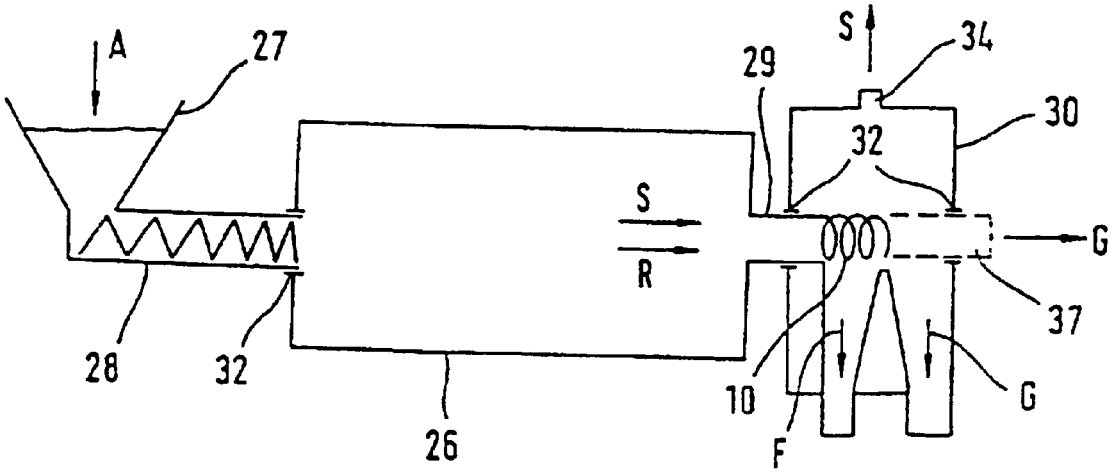
FIG. 3 is a side-elevational view of a low-temperature carbonization drum with a spiral fastened thereto.

According to FIG. 3, a low-temperature carbonization drum 26 of a pyrolysis plant is charged with waste A through a feed shaft 27 and a supply device 28. The waste A is carbonized at about 450° C. in the low-temperature carbonization drum 26. In this case, a low-temperature carbonization gas S and a solid or pyrolysis residue R are obtained. The low-temperature carbonization drum 26 is preferably heated through internal heating tubes which are not illustrated in detail. It is inclined relative to the horizontal and is mounted rotatably. A discharge tube 29 is disposed on that end surface of the low-temperature carbonization drum 26 which is located opposite the supply device 28, and the spiral 10 is fastened at an end surface of the discharge tube 29. The discharge tube 29 and the spiral 10 form the screening device 1. The discharge tube 29 serves at the same time as an aligning device for elongate solid fragments. The fine solid constituents F are separated from the coarse solid constituents G through the use of the spiral 10.

The discharge tube 29 together with the connected spiral 10 open out into a discharge device 30 which is sealed off in a gas-tight manner relative to the rotating low-temperature carbonization drum 26 through sliding-ring seals 32. The supply device 28 is also sealed off in a gas-tight manner relative to the low-temperature carbonization drum 26 through sliding-ring seals 32, in the same way as the discharge device 30. This is done to avoid a situation in which atmospheric oxygen penetrates into the low-temperature carbonization drum 26 and impairs the pyrolysis process, which takes place largely free of oxygen in the low-temperature carbonization drum 26. In addition to the pyrolysis residue R, the low-temperature carbonization gas S is present in the low-temperature carbonization drum 26. The low-temperature carbonization gas S flows through the discharge tube 29 into the discharge device 30 and is diverted from there through a low-temperature carbonization gas extraction connection piece 34.

In an alternative version, the spiral 10 disposed in the discharge device 30 may be followed by a tube 37 which is illustrated by broken lines in FIG. 3 and through which the coarse solids G are discharged from the discharge device 30. In this case, the spiral 10 is disposed between the discharge tube 29 and the tube 37.

The pyrolysis residue R is separated, immediately downstream of the low-temperature carbonization drum 26, into fine solid constituents F and coarse solid constituents G through the use of the configuration of the spiral 10 on the discharge tube 29 of the drum 26. There is therefore only a slight risk of blockage of components located downstream of the low-temperature carbonization drum 26.

The screening device is suitable, in general, for direct connection to rotary tubes, such as, for example, rotating tubular kilns or low-temperature carbonization drums, in which the solids undergo treatment because they are to be separated.

The fine residue F which is separated through the use of the screening device 1 is preferably subjected to so-called air separation for further processing. In this case, the light, in particular carbon-containing solid constituents are separated from the heavy constituents. During such air separation, the solids are supplied to an air stream, so that the light solid constituents are entrained by the air stream. It has proved particularly expedient to have a zig-zag-shaped shaft, into which the air is supplied from below and the solids are supplied from above or laterally.

Figure 4:
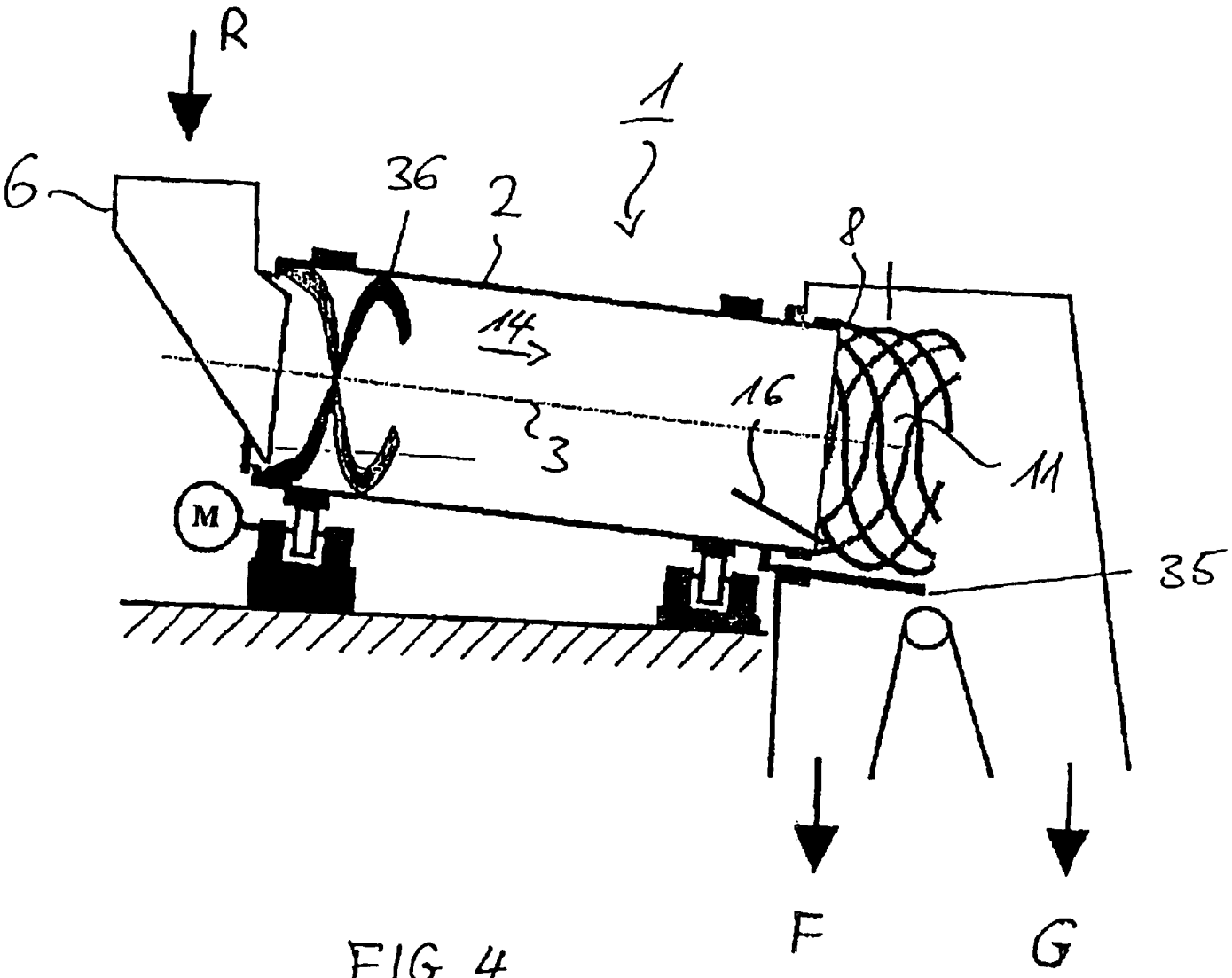
FIG. 4 is a side-elevational view of a screening device with a number of rods as a multi-flight screen.

FIG. 4 illustrates an embodiment which is an alternative to the spiral 10 and in which a number of rods 8 are disposed at the end of the drum 2, instead of the spiral 10. In each case the rods 8 are wound along a helical line and may therefore be considered as a multi-flight coil. The individual rods 8 are disposed in such a way as to be offset in terms of rotation relative to one another, preferably at an angle of 30°, at the end of the drum 2. Each individual rod 8 has an angle of rotation smaller than 360°, that is to say it does not execute a complete revolution. A particularly robust construction thereby becomes possible.

The decisive advantage of this multi-flight coil, and of the spiral 10 according to FIG. 1 as well, is the provision of one or more helically wound rods 8. This is done so that, as a result of the rotational movement of the screening device 1 provided by a motor M, solid fragments which may possibly be caught are automatically transported further to the end of the screening device and are discarded there.

In order to assist this self-cleaning mechanism, provision is made for use of a rod element 35 which runs essentially parallel to an outer surface formed by the rods 8. The rod element 35 may also be disposed in the embodiment having the spiral 10. The rod element 35 ensures that a solid fragment caught on a rod 8 is drawn off from the latter in the conveying direction 14 by virtue of the relative movement between the rod 8 and rod element 35. For this purpose, the direction of rotation of the screening device 1 and the direction of rotation of the rods 8 are coordinated with one another.

In order to increase the stripping action, the rod element 35 is likewise wound along a helical line and intersects the rods 8 preferably at an angle of 90°. The pitch of the rod element 35 preferably increases in the conveying direction 14, in order to increase the stripping action. The action is improved even further if a plurality of rod elements 35 are provided. For example, they may be disposed below the rods 8 approximately in a semicircle.

Another advantage of the provision of the rod element 35 is to be seen in that elongate solid fragments 16 which are not aligned completely parallel to the longitudinal direction 3 in the drum 2 cannot fall through a gap between the rods 8. Specifically, due to the rotational movement of the drum 2, the elongate solid fragments 16 may also be raised, so that they strike the rods 8 at an acute angle at the outlet of the drum 2.

Furthermore, it may be gathered from FIG. 4 that a multiple or multi-flight coil 36 is disposed on the entry side of the drum 2. In the exemplary embodiment, the multiple or multi-flight coil 36 includes two helical plates which are disposed in such a way as to be offset relative to one another in terms of rotation. Other plates may also be provided. The coil 36 is disposed on the inside of the drum 2 and is constructed in such a way that at least two coil portions overlap one another at each point on a drum bottom. Moreover, the Bides of the coil, that is to say the plates, are relatively high. This ensures that the solids R introduced through the feed device 6 are braked and do not fly or shoot through the screening device 1, without the solids undergoing screening.

The multi-flight screen having a plurality of rods 8, which is described in relation to FIG. 4, may replace the spiral screen 10 of FIG. 3 without any restriction.

The screening device described herein is distinguished by a very simple and robust construction and, at the same time, ensures fault-free operation, without blockages occurring. Critical aspects for ensuring reliable operation are the construction of the screening device with the helically wound rod 8 or with the rods 8, the differences brought about by the curvature of the spiral 10 in the distance between the turns, the reliable separation of elongate solid fragments by virtue of the preceding aligning device and the automatic transport of the solids R which is due to the rotational movement and spiral movement.

We claim:

1. A pyrolysis plant for refuse, comprising:

a screening device having an interior for receiving solid residues, a rod wound along a helical line and bounding said interior, and a longitudinal axis, said screening device rotatable about said longitudinal axis.

2. The pyrolysis plant according to claim 1, wherein said rod is constructed as a spiral with a plurality of turns.

3. The pyrolysis plant according to claim 1, wherein said rod is constructed as a spiral with approximately 4 to 10 turns.

4. The pyrolysis plant according to claim 1, wherein said rod is one of a number of rods having rod starts offset in terms of rotation.

5. The pyrolysis plant according to claim 4, wherein said rods have an angle of rotation smaller than 360°.

6. The pyrolysis plant according to claim 4, wherein said rods have an angle of rotation at most approximately equal to 180°.

7. The pyrolysis plant according to claim 1, wherein said wound rod forms an outer surface, and a rod element is disposed fixedly relative to said wound rod and substantially parallel to said outer surface.

8. The pyrolysis plant according to claim 7, wherein said rod element is wound along a helical line in opposition to said rod.

9. The pyrolysis plant according to claim 7, wherein said rod element forms an angle of approximately 90° with said rod.

10. The pyrolysis plant according to claim 7, wherein said rod element is one of a plurality of rod elements having starts offset in terms of rotation.

11. The pyrolysis plant according to claim 1, wherein said rod has a rod start and is fastened only at said rod start.

12. The pyrolysis plant according to claim 1, wherein said rod is flexible.

13. The pyrolysis plant according to claim 2, wherein said spiral has a downwardly curved spiral axis.

14. The pyrolysis plant according to claim 1, wherein said rod is metallic.

15. The pyrolysis plant according to claim 1, wherein said rod is a metallic round iron bar.

16. The pyrolysis plant according to claim 1, wherein said rod is a metallic tube.

17. The pyrolysis plant according to claim 1, including an aligning device for alignment of elongate solid fragments in a conveying direction, said aligning device disposed upstream of said rod and opening into said interior.

18. The pyrolysis plant according to claim 17, wherein said aligning device is a drum having a longitudinal axis, and said aligning device is rotatable about said longitudinal axis of said aligning device.

19. The pyrolysis plant according to claim 18, wherein said drum has a downstream end surface as seen in a conveying direction, and said rod is fastened to said downstream end surface.

20. The pyrolysis plant according to claim 18, wherein said drum has an end surface as seen in a conveying direction, and said rod is welded to said end surface.

21. The pyrolysis plant according to claim 18, including a coil disposed inside said drum.

22. The pyrolysis plant according to claim 18, including a multi-flight coil disposed inside said drum.

23. The pyrolysis plant according to claim 21, wherein said coil forms a closed circle as seen in a top view in the direction of said longitudinal axis of said drum.

24. The pyrolysis plant according to claim 1, including a low-temperature carbonization drum having a discharge side, said screening device connected to said discharge side of said low-temperature carbonization drum for screening pyrolysis residues obtained from said low-temperature carbonization drum.

25. The pyrolysis plant according to claim 2, wherein two of said turns of said spiral define a distance therebetween of approximately 100 to 300 mm.

26. The pyrolysis plant according to claim 2, wherein two of said turns of said spiral define a distance therebetween of 180 mm.

27. The pyrolysis plant according to claim 1, wherein said rod is one of a number of rods defining a distance therebetween of approximately 100 to 300 mm.

28. The pyrolysis plant according to claim 1, wherein said rod is one of a number of rods defining a distance therebetween of 180 mm.

29. The pyrolysis plant according to claim 1, wherein said interior bounded by said rod has a diameter of approximately 1.5 m and a length of approximately 0.5 to 1.5 m.

30. A method for screening solid residues from a pyrolysis plant for refuse, which comprises:

providing a screening device having a longitudinal axis, an interior and a rod wound along a helical line;

introducing residues into the interior of the screening device rotating about the longitudinal axis; and conveying coarse residue constituents with the rod for separating the coarse residue constituents from pure residue constituents.

31. The method according to claim 30, which further comprises initially aligning the residues in a conveying direction in an aligning device and subsequently screening the residues with the rod.

* * * * *

UNITED STATES PATENT AND TRADEMARK OFFICE

CERTIFICATE OF CORRECTION

PATENT NO. : 6,786,335 B1
DATED : September 7, 2004
INVENTOR(S) : Georg Gropper et al.

It is certified that error appears in the above-identified patent and that said Letters Patent is hereby corrected as shown below:

Title page,
Item [73], Assignee, should read as follows -- Siemens Aktiengesellschaft, München (DE) --

Signed and Sealed this

Fourteenth Day of June, 2005

JON W. DUDAS
*Director of the United States Patent and Trademark Office*